US005092262A

United States Patent [19]

Lacy

[11] Patent Number: 5,092,262

[45] Date of Patent: * Mar. 3, 1992

[54] ADJUSTABLE WINDSHIELD AND CANOPY FOR A BOAT

[76] Inventor: Franklin R. Lacy, 12819 SE. 38th Ste. 57, Bellevue, Wash. 98006

[ * ] Notice: The portion of the term of this patent subsequent to May 22, 2007 has been disclaimed.

[21] Appl. No.: 585,995

[22] Filed: Sep. 21, 1990

[51] Int. Cl.[5] ..... B63B 17/00

[52] U.S. Cl. ..... 114/361; 114/343

[58] Field of Search ..... 114/343, 361; 296/84.1, 296/156; 135/88, 95, 107

[56] References Cited

U.S. PATENT DOCUMENTS 3,290,706 12/1966 Hale ..... 114/361
3,312,990 4/1967 Lapworth ..... 114/361
4,926,782 5/1990 Lacy ..... 114/361

*Primary Examiner*—Ed Swinehart
*Attorney, Agent, or Firm*—Jensen & Puntigam

[57] ABSTRACT

A flat, single piece windshield (140) which extends across the front edge of an exposed bridge (142) and is rotatably connected thereto. The windshield (140) includes two elongated support poles (157, 159) which extend, respectively, from the top edge of the windshield (140) downwardly to connecting points along the side edges of the bridge (142). The lower ends of the support poles (157,159) are movable between a series of connecting points on a track, thereby providing a capability for the windshield (140) to be raised and lowered through a large angle relative to the bridge. A canopy (160), which includes lateral (186–189) four side support assemblies (172,174), a top cover and side covers. The canopy (160) may be nested in a stowed position at the rear of the bridge when desired.

6 Claims, 8 Drawing Sheets

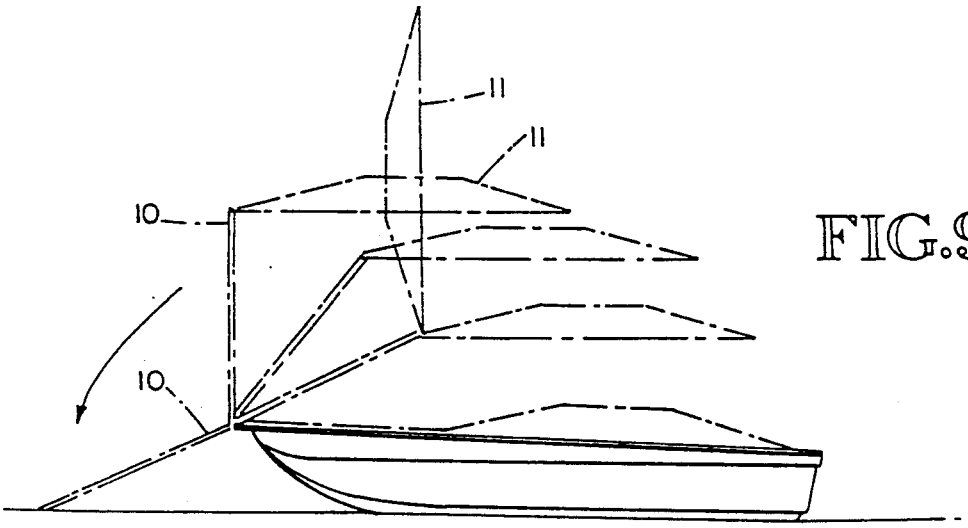
FIG.9
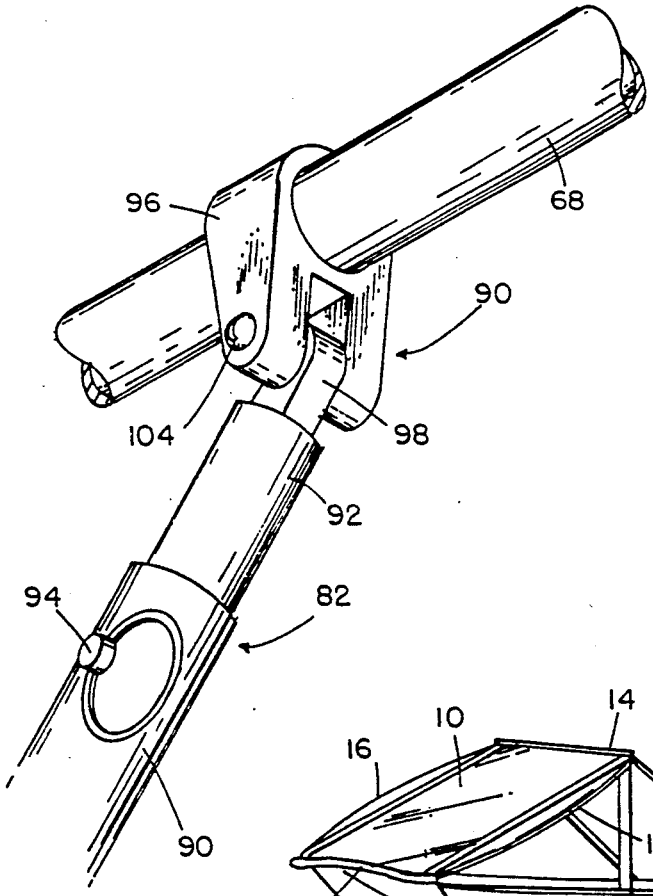
FIG.8
FIG.10
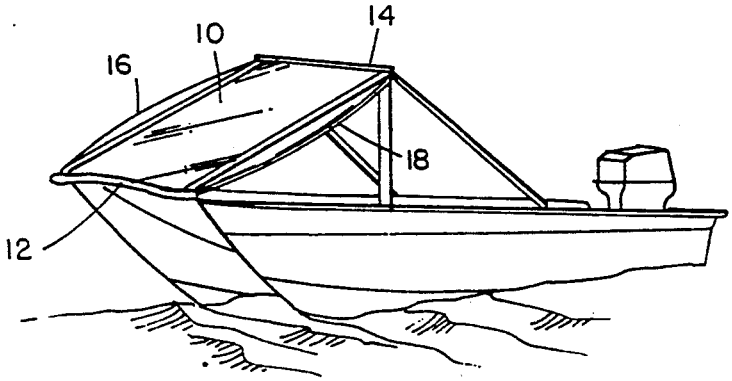

ADJUSTABLE WINDSHIELD AND CANOPY FOR A BOAT

TECHNICAL FIELD

The present invention relates generally to windshields and associated top covers (canopies) for boats, and more specifically concerns a boat windshield and top cover adapted for use with exposed bridge areas, such as a flying bridge or other exposed areas on a boat, and which are adjustable to various positions.

BACKGROUND OF THE INVENTION

Boat windshields for small boats typically comprise two pieces of clear plastic or glass, are relatively small and are typically fixed in position on the boat. Such windshields typically perform but a single function. Boat accessories such as bow ramps, air trim tabs and the like have heretofore been completely separate from the boat windshield. Such articles, as well as others, are often not used with such boats because they are impractical or too expensive.

The wide use of a fixed position, small windshield has also limited the use of top covers, i.e. canopies, for small boats. Existing canopies are typically fixed in position and include a substantial amount of supporting elements. They are often inconvenient to adjust even when they are alleged to be adjustable and are inconvenient to disassemble and stow when not in use. For such reasons and others, canopies are often not used with small boats.

Similar problems arise for exposed bridge areas for larger boats, such as the flying bridge area, and exposed areas on pontoon boats and the like. In such applications, there is typically no windshield provided and the operator of the boat or others in those exposed area are completely exposed to the weather and wind.

DISCLOSURE OF THE INVENTION

The present invention is a windshield element which is adapted for use with a boat having an exposed bridge area or other exposed area where protection is desirable, the bridge having a forward edge and two rearwardly extending side edges. The windshield comprises a windshield element which has top and bottom edges and is sufficiently wide to extend substantially across the bridge area. The windshield also includes means movably and directly connecting the bottom edge of the windshield element in the vicinity of the forward edge of the bridge, such that the windshield element moves about the connecting means at the forward edge of the bridge between a first operative position where the windshield element functions as a windshield and a second position which is angularly removed from the first position. The windshield further includes elongated support means which are rotatably connected at one end thereof to the windshield element and connected at the other end thereof to means in the vicinity of the side edges of the bridge in such a manner that the windshield element may be supported in various angular positions.

BRIEF DESCRIPTION OF THE DRAWINGS

FIG. 8 is an elevational view showing another portion of the canopy frame of the present invention, in particular the telescoping rear leg thereof.

FIG. 9 is a side elevational view showing in simplified form several of the positions of the windshield and/or the windshield/canopy combination of the present invention.

FIG. 10 is an isometric view showing the windshield of the present invention in a partially raised, runabout position.

BEST MODE FOR CARRYING OUT OF THE INVENTION

Figure 1:
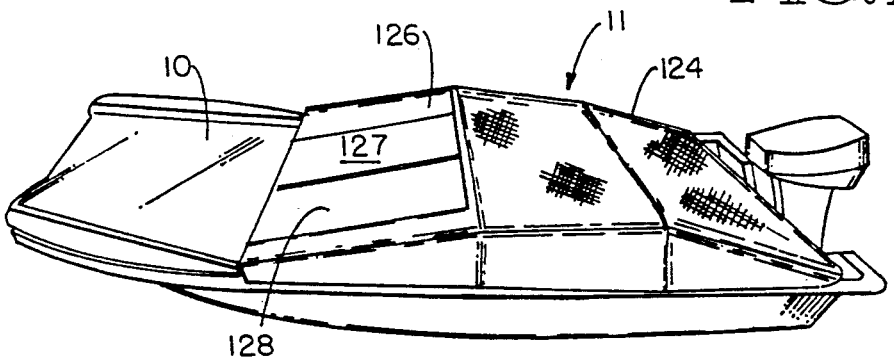
FIG. 1 is an isometric view showing the windshield and canopy combination of the present invention in a lowered position.

FIGS. 2, 3, 5, 10 and 11 show most clearly the boat windshield of one embodiment of the present invention. In the embodiment shown, the windshield, shown generally at 10, is a single piece of scratch resistant, heavy duty plastic, such as LEXAN, from Dupont. Other materials, however, could be used. The front bottom edge 12 of the windshield extends substantially across the entire bow of the boat, and is configured to mate with the configuration of the front edge of the bow of the boat, depending upon the hull configuration of the boat. The windshield 10 extends rearwardly for a substantial portion of the total length of the boat when it is in its lowered position against the gunwales of the boat. As an example, for a boat which is !4 feet long, the windshield 10 is typically 5 feet long. The top edge 14 of windshield 10 is typically straight. The side edges 16 and 18 respectively, connect the front and top edges 12, 14 and are configured to mate with the gunwales of the forward portion of the boat, so that when the windshield is in its lowered position, the side edges 16 and 18 mate with the corresponding portion of the gunwales.

Figure 5:
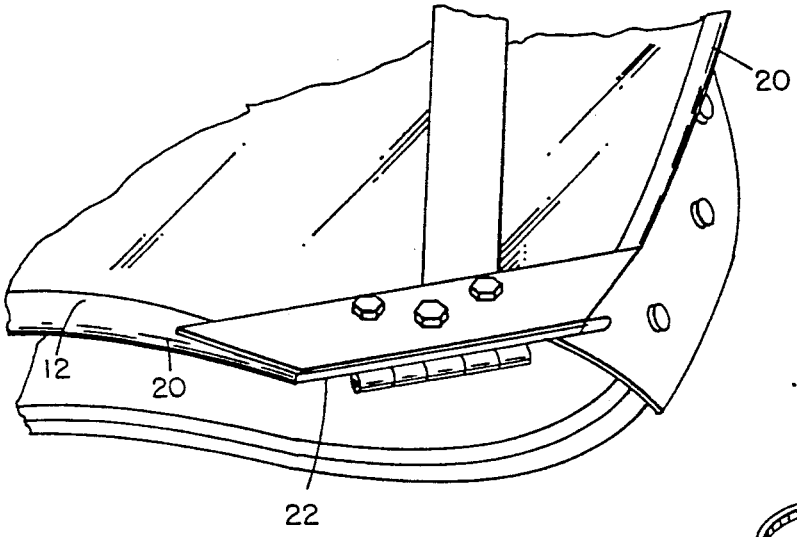
FIG. 5 is an elevational view showing a portion of the windshield pivotally connected to the bow of the boat.

In the one embodiment shown, the exposed edges of the windshield 10 are covered with a vinyl windshield trim 20 (FIG. 5). The windshield 10 is connected to the bow of a two hull boat at the respective corners thereof by two heavy duty hinge elements 20 and 22. For single hull boats with a single pointed bow, the hinge connections would be moved rearwardly sufficiently to maintain the required support. The hinge elements 20 and 22 are arranged so that the windshield 10 may be pivoted from a fully lowered position adjacent the gunwales of the boat through a continuous angle to a position which extends forwardly of the boat and slightly downwardly therefrom, as shown in FIG. 9. The windshield 10 may also be supported in any position between the two extremes. In an alternative embodiment, the hinges 20, 22 are movable forwardly and downwardly to a point beneath the water, enabling the windshield to be used as a viewing window.

Figure 11:
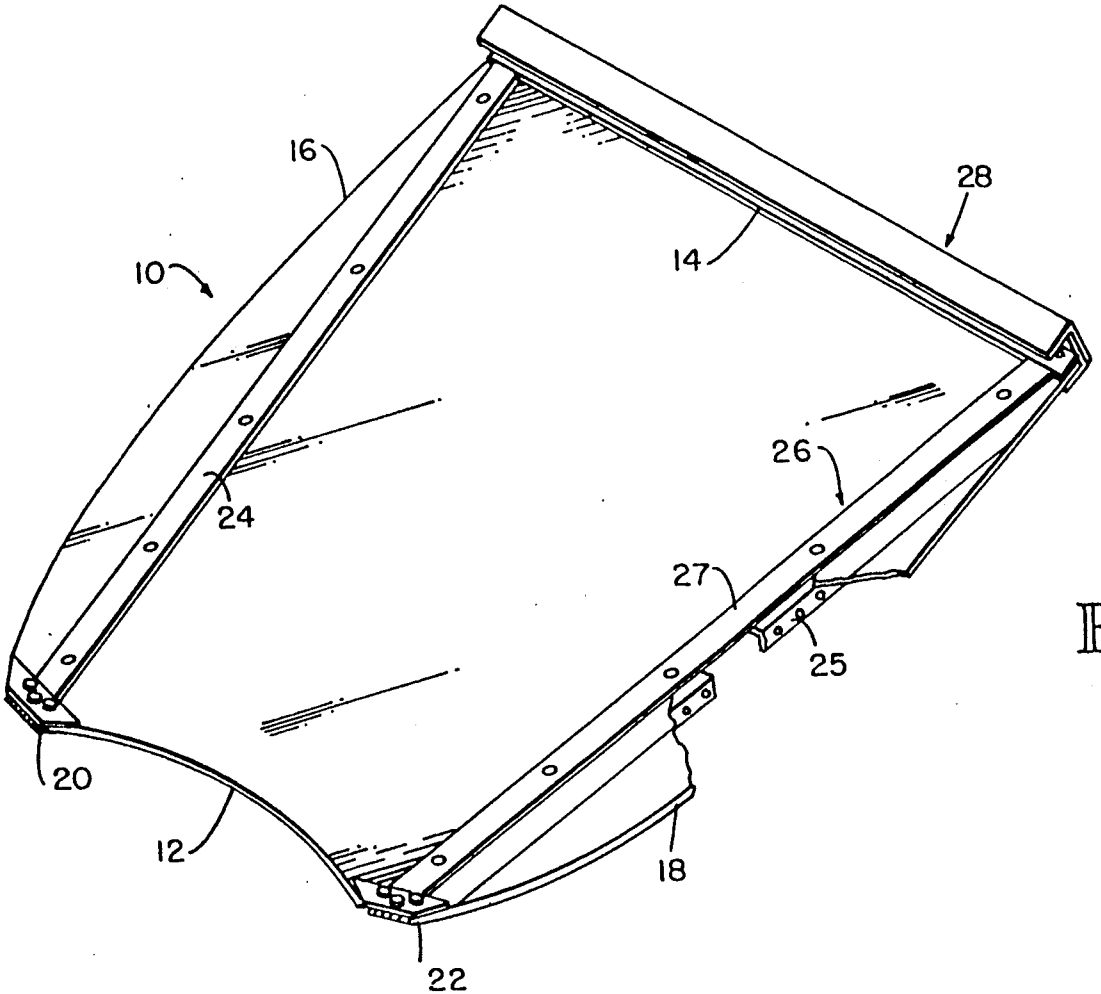
FIG. 11 is an isometric view of the windshield and the frame thereof of the present invention.

A windshield support frame extends rearwardly from the hinge 20 and 22 for support of the windshield, as shown most clearly in FIG. 11. The support frame comprises three sections, including two side sections 24 and 26 which extend from the hinges 20 and 22, respectively, to the top edge 14 of the windshield. Rear section 28 connects the side sections 24 and 26 across the top edge of the windshield. Side sections 24 and 26 each comprise a length of aluminum "L" channel 25 which is positioned underneath the windshield 10, and a flat, narrow length of aluminum plate 27 positioned above the windshield 10. These two elements 25 and 27 are riveted together, capturing the windshield 10 between them. In the embodiment shown, the two side section 25, 27 are made from ⅛ inch aluminum.

Figure 4:
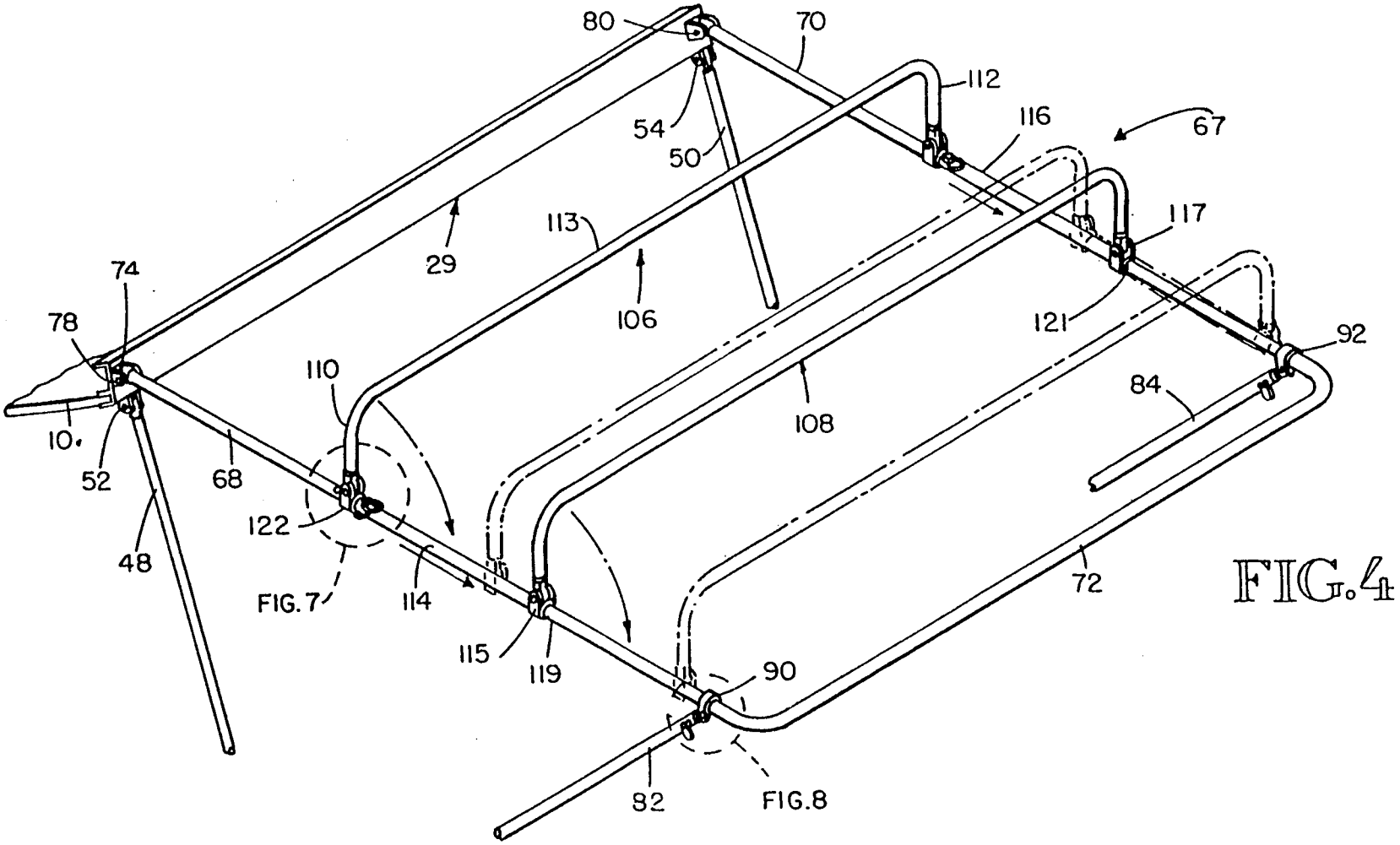
FIG. 4 is an isometric view showing the frame for the canopy portion of the present invention.
Figure 6:
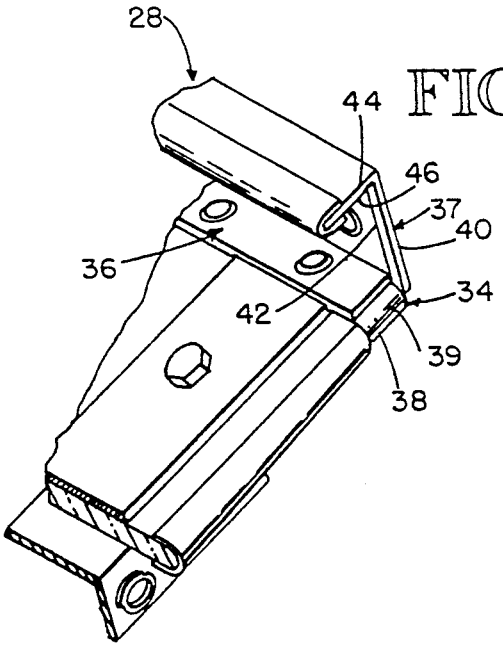
FIG. 6 is an isometric view showing a portion of the top edge and adjacent side of the windshield of the present invention.
Figure 7:
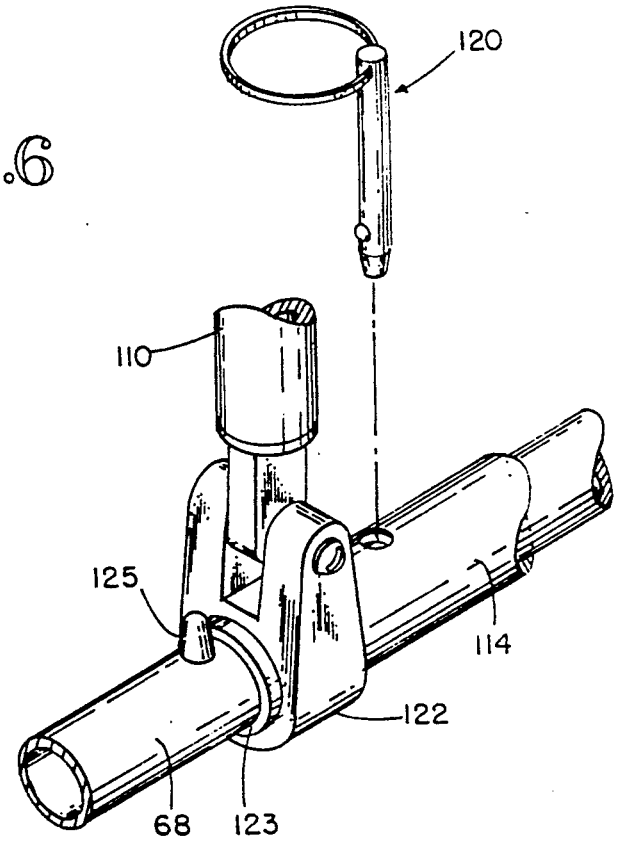
FIG. 7 is an elevational view showing a portion of the frame of the canopy of the present invention.

The rear frame section 28 is shown specifically in FIGS. 4, 6 and 11. Rear frame section 28 comprises three elements 34, 36 and 37. One rear frame element 34 is in the form of an L-shaped section, while element 36 is a narrow flat plate. Rear edge portion 39 of the windshield 10 is sandwiched between a leg portion 38 of L-shaped element 34 and the flat plate 36 and riveted together, thereby providing a stable connection between the rear frame section 28 and the windshield 10. Element 37 is another L-shaped section, arranged so that the long portion 40 of L-shaped section 37 lies adjacent the back of the long portion 42 of L-shaped section 34, with the short portion 44 of L-shaped section 37 extending forwardly a short distance above the plate 36. The two L-shaped sections 34, 37 are riveted together along their long portions. On surface 46 of short portion 44 of L-shaped section 37 are provided a plurality of snaps to which the top cover may be secured.

Extending downwardly from the rear frame section 28, in the vicinity of each end thereof, are two elongated support poles 48 and 50. In the embodiment shown, the support poles 48, 50 are ½ inch aluminum tubing, and approximately 96 inches long. Support poles 48 and 50 are rotatably connected at their upper ends to the rear frame section 28 at connections 52 and 54 by screws or the like.

Figure 12:
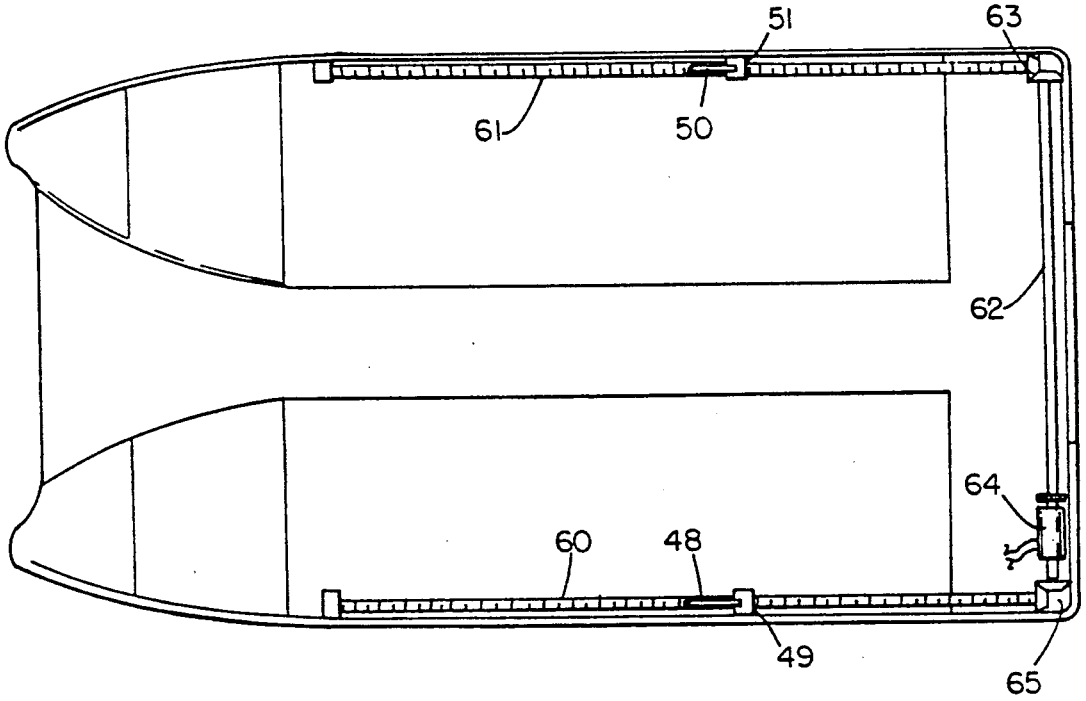
FIG. 12 is a top view of a boat showing the means for raising and lowering the windshield of the present invention.
Figure 13:
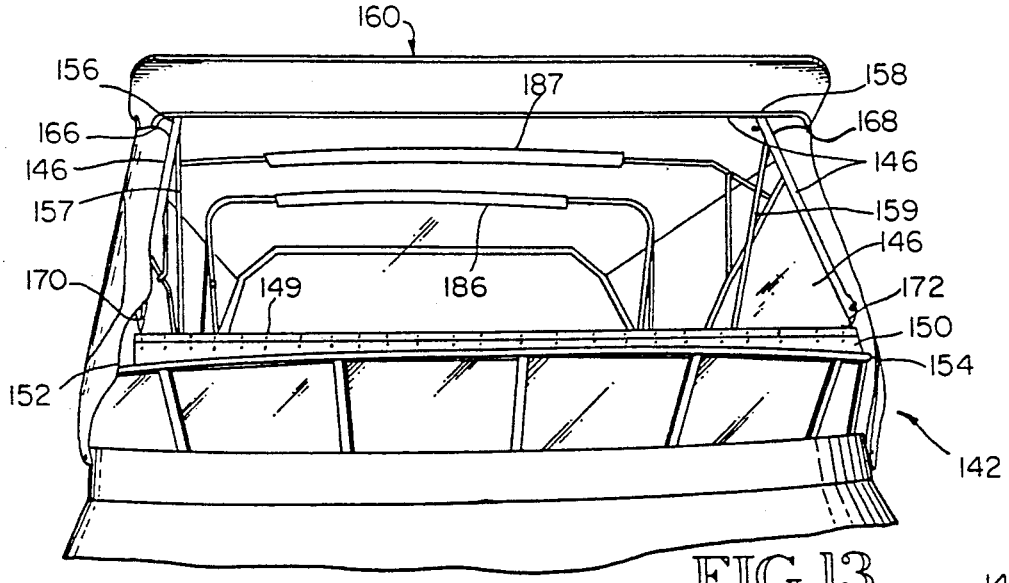
FIG. 13 is a front elevational view of another embodiment of the present invention.

Support poles 48 and 50 are connected, respectively, at their lower ends 49, 51, to elongated tracks (FIG. 12) which extend longitudinally of the boat along each side thereof, slightly below or at the gunwales of the boat. In the embodiment shown, side worm gears 60, 61 in the tracks move the ends 49 and 51 of the support poles along the tracks. At the rear of the boat in the embodiment shown is a driveshaft 62 which is connected by bevel gears 63,65 to the two longitudinal worm gears 60, 61. The driveshaft 62 is controlled by a motor 64. Thus, the lower ends 49, 51 of the support poles 48 and 50 move longitudinally of the boat in unison by action of worm gears 60 and 61, which results in a change of position of the windshield.

Alternatively, a chain drive can be used instead of the driveshaft 62 or support poles 48, 50 can be connected to the boat by locking pins or the like in detentes located at spaced positions along the longitudinal dimension of the boat, either along the sides or bottom of the boat.

In the embodiment shown, the support pole/worm gear arrangement is such that the windshield 10 is capable of moving under positive control from a completely lowered position adjacent the gunwales of the boat through an angle of 180° and even greater so that the windshield 10 extends beyond the bow of the boat and downwardly relative to the longitudinal plane of the boat. In all positions, however, the windshield 10 is supported by the hinge elements 20 and 22 and the support poles 48 and 50.

FIGS. 1–3, 4, 7, and 9 show the canopy portion 11 of a combination windshield/canopy usable with the above-described windshield. The canopy 11 includes a frame 67 which is shown most clearly in FIG. 4. The frame 67 comprises side tube elements 68 and 70 which extend rearwardly of the boat from the opposite ends of rear frame section 28 of the windshield support frame. The side tube elements 68 and 70 are connected by a rear tube element 72. In the embodiment shown, for a 14 foot boat, with a 5 foot windshield, the length of side tube elements 68, 70 are approximately 8 feet and the canopy as a whole is approximately 8.5 feet. The side tube elements 68 and 70 are rotatably and removably connected at connections 74 and 76 to the rear frame section 28 of the windshield support frame. Pin elements 78 and 80 may be conveniently removed to permit removal of the side tube elements 68 and 70.

Figure 2:
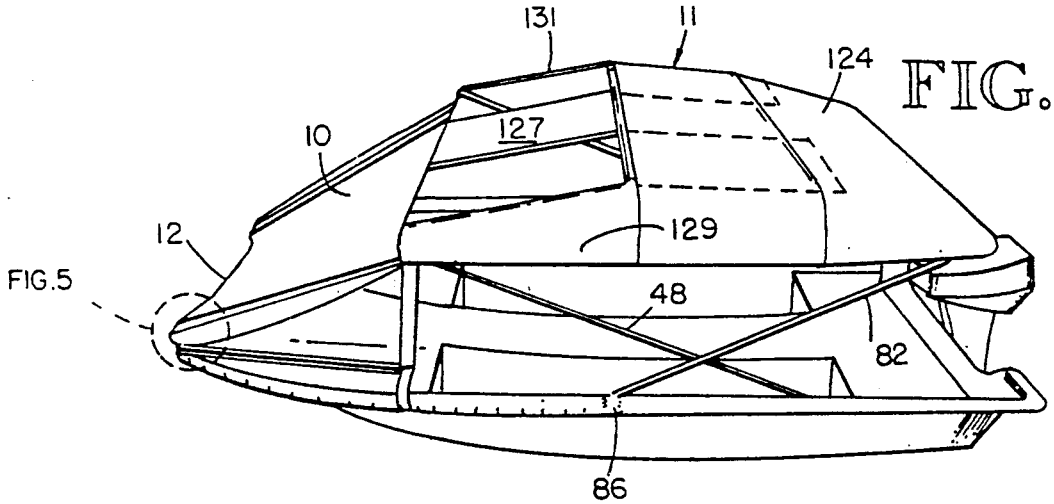
FIG. 2 is an isometric view showing the windshield and canopy combination of FIG. 1 in a partially raised position.
Figure 3:
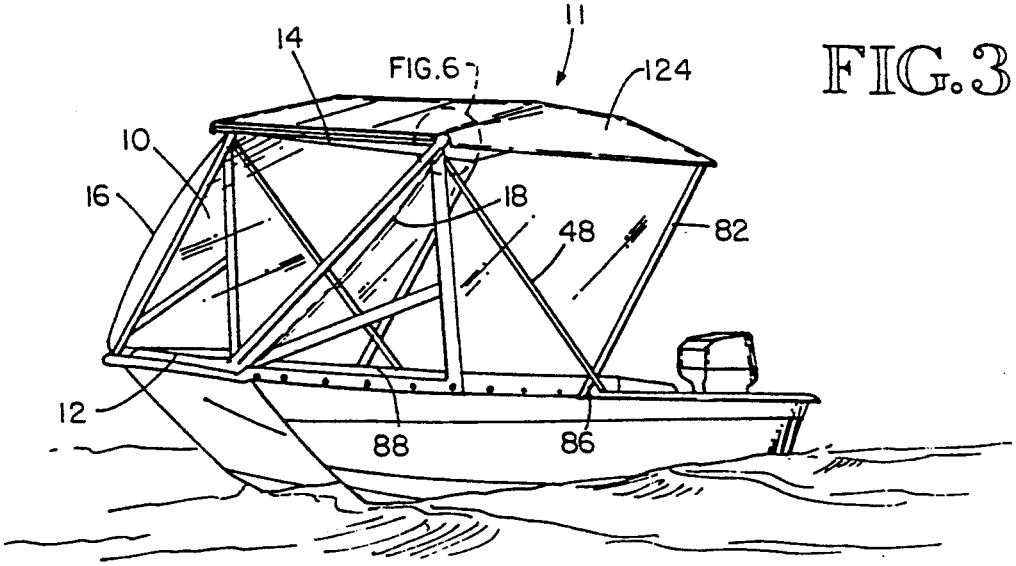
FIG. 3 is an isometric view showing the windshield and canopy combination of FIG. 1 in a more fully raised position.

Extending downwardly from the vicinity of the rear end of the side tube elements 68 and 70 are two side support poles 82 and 84. The poles 82 and 84 are rotatably connected to side tube elements 68 and 70 at connections 90 and 92, respectively. Side support poles 82 and 84 in the embodiment shown are arranged to telescope, and extend at an angle downwardly to pivotable connection points 86 and 88 along the gunwales of the boat (FIGS. 2 and 3). The poles 82, 84 are connected by pins (not shown) or the like to connection points 86, 88, permitting quick disconnection thereof. Connection points 86 and 88 are fixed relative to the longitudinal dimension of the boat.

FIG. 8 shows in detail the telescoping nature of side support poles 82 and 84. Each telescoping pole, i.e. pole 82, comprises two concentric pole elements 90 and 92. Each pole element has a plurality of spaced openings therein (not shown). A ringed pin 94 is selectively positioned through openings which are in registry in the pole elements 90 and 92 to provide the telescoping capability for the pole. The connection 90, for example, includes a bracket 96 which depends from side tube element 68. Mating with the bracket 96 is an ear-like element 98 which extends upwardly from the top end of pole element 92. The ear-like element 98 is rotatably connected to the bracket 96 by a pin or screw 104. The entire side support pole 82 may thus be easily disconnected from the side tube element 68 by removal of pin 104.

Referring again to FIG. 4, the frame 67 of the canopy 11 includes two top support elements 106 and 108, both in the form of shallow, U-shaped elements, extending between side tube elements 68, 70, and typically comprising ½ inch aluminum tubing. In the embodiment shown, the top support elements 106, 108 are each approximately 65 inches long, i.e. the length of the horizontal middle portion 113, while the vertical leg portions 110 and 112 at each end of the middle portion 113 are approximately 6 inches long.

The top support elements 106 and 108 are each pivotally and removably connected at each end thereof to opposing sections of tubing 114 and 116 which have a slightly larger internal diameter than the exterior diameter of side tube elements 68 and 70. Sections 114 and 116 thus are capable of sliding along side tube elements 68 and 70. The pivoting connections 115 and 117 which connect top support element 108 to tubing sections 114 and 116 are fixedly connected to the rear ends 119, 121, respectively, thereof. Similar pivoting connections 122, 124 for top support element 116, however, are slidable along tubing sections 114 and 116. Connections 122, 124 are held in position near the front ends of tubing sections 114 and 116 by a ring and pin element 120. Element 120 also holds the tubing sections in place, as shown most clearly in FIG. 7. A rounded extension 125 is located on the surface of side tube element 68 adjacent the front end 123 of tubing section 114. This prevents tubing section 114 and bracket 122 from sliding forward. A similar structure is present for tubing section 116.

When pin 120 is removed, section 114 may be slid to the rear of the frame 67 and connection 122 may be slid to the rear of section 114, adjacent top support element 108. In this position, the two top support elements 108 and 106 are at the very rear of the frame 67. Further, the two top support elements can be pivoted downwardly and to the rear, thereby bringing elements 108 and 106 substantially adjacent rear section 72.

The frame 67 supports a cloth cover shown generally at 124 (FIGS. 1, 2, 3) which is secured to side tube elements of the frame and supported by the top support elements thereof. The cover 124, in the area between the top edge of the windshield 10 and top support element 106, is divided into three sections 126, 127, 128 which are secured to each other along their respective side edges by zippers or the like. The front edge of each section is secured to the rear frame section 28 of the windshield frame by snaps or the like. In the embodiment shown the sections 126–128 are equal in dimensions. They can be individually removed, or tucked rearwardly under the remaining cover, as shown in FIG. 2, to provide different shading effects, as desired. In addition, side cover sections 129, 131 can be removed as well.

FIG. 1 shows the windshield and cover combination in a fully stowed position. In the fully stowed position, the windshield 10 lies flat against the gunwales of the boat, as does the frame and cover of the canopy. The longitudinal edges of the cover can be attached via snaps or the like to the gunwales of the boat. Top support members 106 and 108 can be pivoted so that they are substantially parallel to the gunwales of the boat.

FIG. 2 shows the windshield and cover in a partially raised position. To move the structure to this position, it is simply necessary to move the support poles 48 and 50 of the windshield somewhat forwardly. This action raises the windshield an raises the canopy as well. In this position, the windshield 10 is at an angle of approximately 30° relative to the plane of the gunwales. This is a good runabout position, and provides a good "air trim" capability for the boat. The actual airflow over the bow can be easily adjusted by changing the angle of the windshield.

FIG. 10 shows the windshield in such a position without the canopy. This position of the windshield tends to force the bow of the boat downward so that the boat will "plane", i.e. skim over the top of the water, at a lower speed then otherwise, thereby increasing safety and maneuverability and economy of operation.

FIG. 3 shows a further raised position of the windshield 10 in which the support poles 48 and 50 have been moved further forward than shown in FIG. 2. In this position, the windshield is at an angle of approximately 60° relative to the plane of the gunwales. This position of the windshield provides full utilization of the area of the boat, with up to 7 feet of head room while providing protection from inclement weather.

FIG. 9 shows further positions of the combination of the windshield 10 and the canopy 11. In one position, note that the windshield 10 is substantially vertical and the canopy 11 is substantially horizontal, providing an awning-like effect for the boat. The canopy awning can then be moved upwardly from the horizontal by means of the telescoping support poles. In one such position, the canopy 11 is positioned vertically so that it acts like a sail.

The canopy 11 can be removed from the windshield 10 by disconnecting the pins in the two pivot connections at the top edge 14 of the windshield. This permits the windshield to be rotated further forward, either into a lounge position, which is approximately 120° relative to the plane of the boat, or beyond 180° so that it acts as a bow ramp, or as a fish viewing window. This also permits the frame of the canopy to rest on the gunwales of the boat with the cloth top gathered fully rearward to provide maximum room within the boat.

The combined single piece windshield and canopy arrangement for a boat described above is position-adjustable and thereby provides a great number of operational advantages. It should be understood that the windshield can be used either alone, or in combination with the canopy, each of which individually has several significant advantages.

Another embodiment of the present invention is shown in FIGS. 13–16. In these FIGURES is shown a windshield and a canopy for boats other than the specific boat shown in the above-described embodiment. Typically the embodiment of FIGS. 13–16 will be used on larger boats around an exposed bridge portion thereof, or other exposed portion for which protection is desired. One example, which is illustrated in FIGS. 13–16, is what is referred to as a "flying bridge". A flying bridge typically is located on a second level of a larger boat, above the main cabin area. A flying bridge, with a full complement of control elements for the boat, is typically completely exposed to the elements and therefore can be uncomfortable for the user and/or any passengers. Another example is what is known as a pontoon boat, which is not specifically illustrated herein, but does include exposed areas where protection from wind/weather may be desirable.

The basic problem with any boat having an exposed bridge area for instance, is similar to that for smaller boats discussed above, and that is the lack of any protection such as a windshield and/or canopy, against the weather, wind and/or water spray, etc. It is also desirable that protective elements can be conveniently stowed when not in use.

The windshield 140 of FIGS. 13–16 is a plane, single piece section of glass or clear plastic, and in the embodiment shown extends across the full width of the flying bridge (or other exposed area), referred to generally at 142. The flying bridge 142, as mentioned above, contains auxiliary controls for the boat, so that the person controlling the boat can do so either from the main cabin, shown generally at 144, or from the flying bridge. In the embodiment shown, the windshield 140 is approximately 2¼ to 3¼ feet high, but this dimension may vary depending upon the particular application. The windshield 140 is generally rectangular and includes a frame 146 which extends around the entire boundary thereof. The lower frame portion 149, which extends along the lower edge of the windshield, is rotatably connected to a T-shaped mounting beam 150 located at the front edge of the flying bridge railing, by means of hinges, such as a piano hinge, or the like. The rotatable connection permits the windshield 140 to be rotated about the front edge of the flying bridge either forwardly or rearwardly. In one arrangement, the windshield can be rotated rearwardly so that it lays flat against the rearwardly extending side railings 152 and 154 of the flying bridge, thereby providing a convenient stowing capability.

Extending downwardly from the top corners 156 and 158 of the windshield 140 are two support poles 157, 159 which are connected to one of several attachment points along the sides of the flying bridge, or along a track which is positioned along the sides of the flying bridge. Movement of the poles 157, 159 along the sides of the flying bridge will determine the position of the windshield 140.

The canopy, shown generally at 160, extends, when fully deployed, from the top of windshield 140 and across the entire width thereof, to a radar arch 162 at the rear of the flying bridge area. Although the canopy 160 shown in FIGS. 13–16 is adapted to conform to the radar arch 162 shown, it should be understood that the canopy may be used with flying bridge arrangements or in other exposed areas of the boat which do not have a radar arch or similar apparatus.

Canopy 160 includes a support structure which comprises a plurality of interconnecting, hollow metal poles, like that discussed above with respect to the first embodiment. Briefly, the support structure includes two forward poles, 166 and 168, which extend alongside the side edges of the windshield 140 and are pivotally connected at their lower ends 170 and 17 by means of a removable pin to the mounting beam 150 in the vicinity of the lower corners of the windshield. The upper ends of the forward poles 166 are pivotally connected to the remainder of the canopy support structure. The remainder of the canopy support structure includes a plurality of lateral support poles 186–189, each in the form of a shallow "U", which extend from side to side of the area to be covered and provide support for the cloth cover portion of the canopy. In the embodiment shown there are four such poles, the first one being located slightly forwardly of the top of the windshield when the canopy is in its extended position, and the remaining ones being spaced successively to the rear of the first one.

Figure 14:
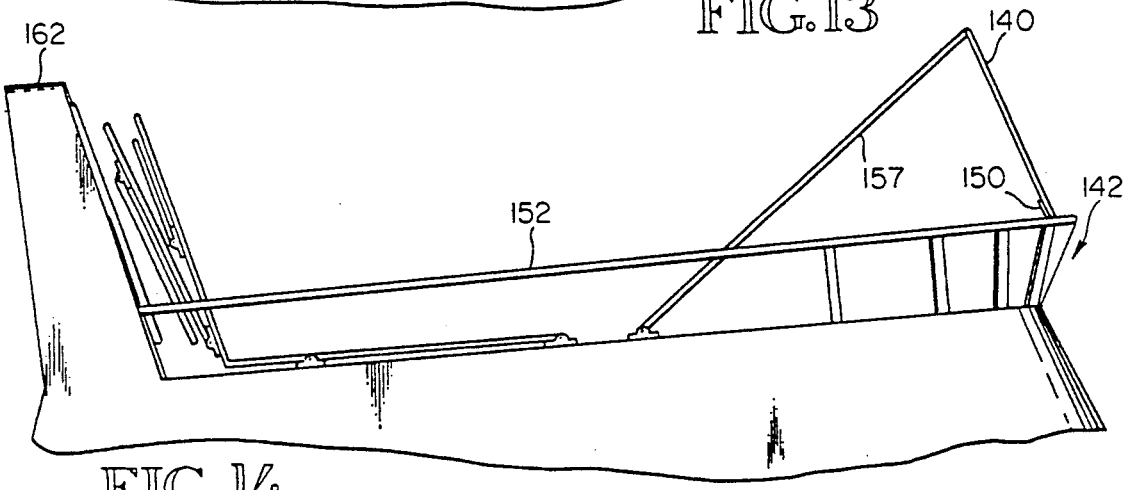
FIG. 14 is a side elevational view of the embodiment of FIG. 13, with the canopy support structure in a stowed position.
Figure 15:
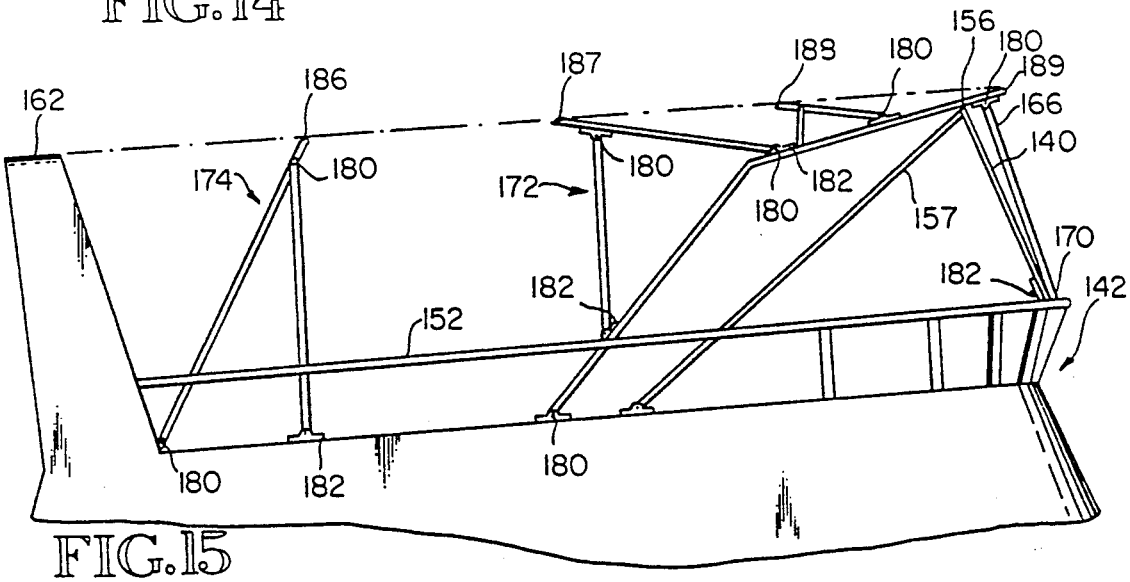
FIG. 15 is a side elevational view of the embodiment of FIG. 13, with the canopy support structure in an extended, operative position.
Figure 16:
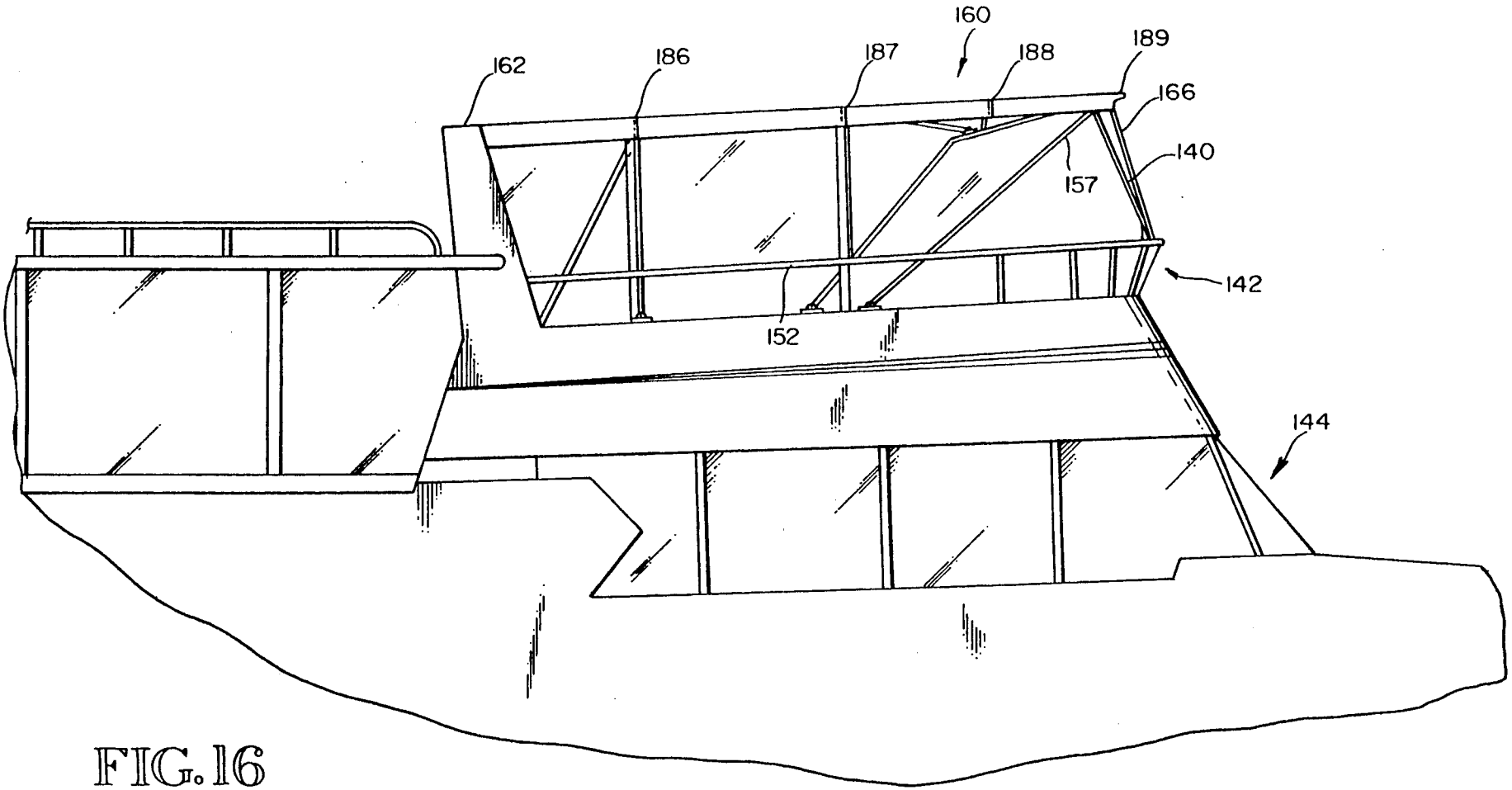
FIG. 16 is a side elevational view of the embodiment of FIG. 14.

Extending downwardly from, and supporting, the lateral support poles are a plurality of side support pole assemblies, two for each side. The side support assemblies are in turn connected to and supported by the sides of the bridge, as shown in FIG. 15. Each side support assembly includes several pole elements connected in such a manner as to permit the entire canopy structure to be moved rearwardly from its position in FIG. 15, nesting ultimately against the radar arch, as shown in FIG. 14. The forward side support assemblies 172 (one on each side) are somewhat more complicated in their structural arrangement than the rear side support assemblies 174, but both use a combination of pivot joints and removable pins to provide the desired fore and aft movement of the canopy structure, between a stowed position and a fully extended, i.e. deployed, position. In the fully deployed operational position, the forwardmost lateral support pole 189 is located slightly forwardly of the top edge of the windshield 140, which is typically at an angle of 10°–20° rearwardly from the vertical, so that the front edge of the canopy slightly overhangs the top edge portion of the windshield 140. In the embodiment shown, this overhang is approximately 6–8 inches, but this could be varied.

In the embodiment shown, cloth top portions (bimini top) extend over the lateral support poles, serving as a cover for the bridge area. The cover is in four sections, one section extending between the radar arch 142 and lateral support pole !86, the second section extending between support pole 186 and support pole 187, the third section extending between support pole 187 and support pole 188, and the fourth section extending between support pole 188 and the most forward support pole 189. The cloth sections may be connected by snaps or zippers. One or more of the sections may be removed or folded forwardly or rearwardly to give different cover configurations. Extendingly downward from the top portions are side covers. The side covers include clear plastic portions which serve in essence as windows for the canopy. The side covers are connected to the top cover and to the bridge, again by means of snaps or zippers. This results in the flying bridge area essentially being completely enclosed except for the very rear portion which can also be enclosed by a rear curtain of some kind. This enables the person controlling the boat and/or any passengers to comfortably be in the flying bridge area even in somewhat inclement weather.

Hence, the embodiment of FIGS. 13–16 is directed toward a windshield and canopy arrangement for flying bridges and other areas on a boat, where the windshield itself, which is structurally independent of the canopy, may be rotated to various selected positions, including a stowed position in which the windshield is rotated a substantial distance rearwardly toward the bridge or other lower surface, in some cases lying in essentially the same plane or somewhat below the railing of the bridge. The canopy itself may be conveniently moved between a fully extended or forward position, referred to as an operative position, or a nested position at the rear of the bridge.

Although embodiments of the invention have been disclosed herein for illustration, it should be understood that various changes, modifications and substitutions may be incorporated in such embodiments without departing from the spirit of the invention as defined by the claims which follow.

I claim:

1. An adjustable windshield, adapted for use with a boat having an exposed area, the exposed area having a forward edge and two rearwardly extending side edges, comprising:

a transparent windshield element, having top and bottom edges, the windshield element being sufficiently wide to extend substantially across the exposed area;

means movably and directly connecting the bottom edge of the windshield element in the vicinity of the forward edge of the exposed area, such that the windshield element moves about the connecting means at the forward edge of the exposed area between a first, raised position in which the windshield element functions as a windshield and a second position which is substantially angularly removed from the first position;

elongated support means which are rotatably connected at one end thereof to the windshield element; and means connecting the other end of the elongated support means to the exposed area in the vicinity of the side edges thereof in such a manner that the windshield element may be supported in various angular positions.

2. An apparatus of claim 1, wherein the exposed area is an exposed bridge.

3. An apparatus of claim 1, wherein the windshield element is a single piece.

4. An apparatus of claim 1, wherein the other end of the elongated support means is connectable at selected locations along the side edges of the exposed area.

5. An apparatus of claim 4, wherein said elongated support means comprises two support poles positioned at opposite sides of said windshield element, wherein the support poles are connected to the windshield element at opposing ends of the top edge thereof.

6. An apparatus of claim 1, including a canopy system which includes a plurality of elongated lateral frame elements for supporting a cover member and a plurality of side support assemblies extending between the lateral frame elements and the side edges of the exposed area, wherein the side support assemblies are so constructed and are so connected to the lateral frame, elements and the side edges of the exposed area by means of removable pins and rotatable connection elements that the canopy may be moved between a fully operative forward position wherein the canopy extends from the vicinity of the top edge of the windshield element rearwardly of the exposed area a substantial distance and a stowed position at the rear of the exposed area, in which position the exposed area is substantially completely exposed.

* * * * *